United States Patent [19]

Jones-Hinton

[11] Patent Number: 4,585,371

[45] Date of Patent: Apr. 29, 1986

[54] LINING OF TUBULAR STRUCTURES

[75] Inventor: James Jones-Hinton, Cumbria, England

[73] Assignee: Dunlop Limited, London, England

[21] Appl. No.: 643,753

[22] Filed: Aug. 23, 1984

Related U.S. Application Data

[63] Continuation of Ser. No. 357,218, Mar. 11, 1982, abandoned.

[30] Foreign Application Priority Data

Mar. 14, 1981 [GB] United Kingdom ..... 8108058

[51] Int. Cl.[4] ..... E21D 11/00

[52] U.S. Cl. ..... 405/153; 405/150

[58] Field of Search ..... 405/146, 150–153; 52/86, 89, 582, 586, 604, 605, 743, 744, 245; 160/235; 249/10, 11, 209; 425/59; 264/32

[56] References Cited

U.S. PATENT DOCUMENTS

| | | | |
|---|---|---|---|
| 1,004,288 | 9/1911 | Alpine | 405/151 |
| 1,347,247 | 7/1920 | Caine . | |
| 1,378,158 | 5/1921 | West et al. | 405/151 |
| 1,572,197 | 2/1926 | Ferguson . | |
| 1,642,417 | 9/1927 | Kovanda et al. . | |
| 1,683,025 | 9/1928 | Dallam . | |
| 1,870,539 | 8/1932 | Warner et al. | 405/152 |
| 1,881,421 | 10/1932 | Coyle | 405/152 |
| 2,257,513 | 10/1941 | Pilcher | 160/235 |
| 4,075,855 | 2/1978 | Meldner | 405/152 |

FOREIGN PATENT DOCUMENTS

| | | | |
|---|---|---|---|
| 1147550 | 9/1963 | Fed. Rep. of Germany | 405/153 |
| 1191640 | 4/1965 | Fed. Rep. of Germany . | |
| 2329565 | 1/1974 | Fed. Rep. of Germany | 405/150 |
| 1194978 | 11/1959 | France . | |
| 2071769 | 9/1971 | France . | |
| 2273120 | 12/1975 | France | 405/150 |
| 863266 | 3/1961 | United Kingdom | 405/150 |
| 1188280 | 4/1970 | United Kingdom . | |
| 1286957 | 8/1972 | United Kingdom . | |
| 2007743 | 5/1979 | United Kingdom . | |

*Primary Examiner*—Dennis L. Taylor
*Assistant Examiner*—Nancy J. Stodola
*Attorney, Agent, or Firm*—Stevens, Davis, Miller & Mosher

[57] ABSTRACT

A tubular structure, such as a sewer, is lined by the use of long length elements having edge formations which facilitate a number of the elements being arranged in a side-by-side interlocked configuration within the tunnel structure. At least some of the elements are formed with a cavity into which a settable compound may be injected thereby to strengthen the lining when set. Preferably the elements are relatively flexible prior to injection with the settable compound so as to facilitate storage of long lengths on a drum.

14 Claims, 7 Drawing Figures

LINING OF TUBULAR STRUCTURES

This application is a continuation of application Ser. No. 357,218, filed Mar. 11, 1982, now abandoned.

This invention relates to a method of and means for forming a lining in a preformed tubular structure, and in particular, though not exclusively, to the lining of tunnel-type structures such as sewers.

Many underground tunnels in the U.K. and overseas, and especially those used as sewers, were constructued some 80 to 150 years ago and it is now found that although the bricks used in construction of the tunnels are still in sound condition in many instances the mortar between the bricks is severely eroded.

In consequence of this erosion a tunnel's ability to withstand external ground pressure is substantially reduced and frequently a localised length of tunnel will collapse thus resulting in much inconvenience and the need for extensive and urgent repair work.

To guard against inadvertent collapse the brick-work can be repointed but this is a very time consuming and expensive operation, particularly for the smaller of the man entry type tunnels in which working space is very restricted.

The alternative approach of forming a new lining within the tunnel has the potential advantage of facilitating provision of a smooth surface having low fluid flow resistance, and also of reducing the requirement for extensive manual work within the restricted space of a tunnel. However, in the currently known lining techniques, the lining structure is relatively expensive, or time consuming to install, or there is a requirement for extensive ground excavation at intervals along the length of the tunnel in order to facilitate maneouvring of the lining structure into the tunnel.

The present invention seeks to provide a method of lining a tubular structure, and lining elements therefor, in which the aforedescribed difficulities are mitigated or overcome.

In accordance with one aspect of the present invention a method of lining a tubular structure comprises:

feeding into the structure a plurality of elongate elements at least some of which are of a kind having at least one cavity;

arranging the elements to extend substantially parallel with the direction of the length of the structure, and with said elements disposed in a side-by-side and interlocking configuration to form a lining which conforms substantially to the internal surface of the tubular structure;

and then injecting into said cavities settable compound.

In addition to injecting settable compound into said cavities preferably a settable compound is injected between the internal surface of the tubular structure and the external surface of the lining of elongate elements.

The settable compound may be allowed to set before further compound is injected between the tubular structure and elongate elements, or settable compound may be caused to flow substantially simultaneously into the cavities and between the lining and tunnel structure.

Preferably the elongate elements are brought into side-by-side relationship by feeding successive lengths into the tubular structure in such a manner that they slide along and are guided by the edge of an elongate element which is already installed in the tubular structure. Preferably an elongate element is guided during insertion by means which also effects interlocking of successive elements.

Preferably the elongate element has a length substantially greater than the maximum cross-sectional dimension of the tubular structure being lined thereby to facilitate relatively speedy installation of a lining and minimise the need to effect numerous joints between the ends of successive lengths of the elongate elements.

Typically the length of each elongate element employed should be at least ten times, and preferably 50 or more times the maximum cross-sectional dimension of the element. Lengths of 100 meters or more are envisaged. Where, however, the requirements of the lining dictate otherwise, e.g. gaps in the lining for side entrant tunnels, use may be made of some elongate elements of shorter length.

Particularly where the elongate element is of a very long length, lubricant means, either a low frictional material or lubricating fluid, may be employed to facilitate sliding movement of one element into position alongside another element.

Relative movement of an assembled pair of interlocked elements may be restrained by the use of an adhesive. Accordingly those elements which form a roof lining may be supportd by adjacent elements with a need for only minimal, if any, temporary support. Preferably the adhesive is of a slow acting kind and incorporated in or serving as the aforementioned lubricant.

The elongate elements may be fed singly into the tubular structure or two or more elements may be preassembled together in side-by-side relationship before being fed into the tubular structure.

Suitable settable compounds of filling the cavities of the elongate elements to effect reinforcement thereof include:

grouts including cement base mixtures, and polymer and/or resin based materials.

Suitable settable compounds for injection between the lining of elongate elements and the internal surface of the tubular structure include those mentioned in the preceding paragraph.

In accordance with another aspect of the present invention an elongate element for use in lining a tubular structure comprises a pair of face members maintained spaced apart to define therebetween at least one cavity into which a settable compound may be injected, and a pair of substantially longitudinally extending formations at opposite edges of the face members thereby to facilitate interlocking of said elongate elements in parallel side-by-side relationship with another elongate element.

Preferably said formations are complementary shaped such that a pair of said elements may be interlocked directly together. Alternatively however a pair of elements with similar formations may be interconnected by a third element having formations complementary to those at the edges of said pair of elements to be joined. The third element may be of a kind as defined in the preceding paragraph or it may be of a different construction.

The substantially longitudinally extending formations may serve also as guide means to facilitate one elongate member being slid into interlocking side-by-side relationship with another elongate element.

At least one of a pair of formations may be formed of a low friction material, or provided with means for facilitating lubrication of movement between two complementary shaped formations.

One of the formations may be hollow, or otherwise shaped such that a lubricant may be supplied therethrough to facilitate relative sliding movement between the complementary shaped formation.

Preferably said cavity within the element extends substantially continuously along the length thereof. The face members of the elements may be maintained spaced apart by dividers extending continously along the length of the element, and said dividers may serve to define in part two or more cavities.

The elements may be of different shapes; elements of one shape may have a longitudinally extending rib-like formation and act as spacers which contact the wall of the tubular structure and maintain other successive elements spaced therefrom.

Not all of the elements used to form the lining of a tunnel need be elements of a kind in accordance with the present invention. Thus, some of the elongate elements, such as those used as wall spacers, need not be of a kind having cavities.

Suitable materials for forming the elongate elements incude polyethylene, polypropylene, polycarbonates, and unplasticised p.v.c. Of these it is preferred for many applications to employ materials such as unplasticised p.v.c. which are relatively light weight whilst also being of a relatively low coefficient of friction such that complementary shaped formations constructed integral with the elongate element readily facilitate relatively sliding movement of two elements into side-by-side interlocking relationship.

Although the elongate element should be substantially rigid so as to be adequately self-supporting to form the lining of a tubular structure, at least when cavities thereof are filled with a settable compound which has been allowed to set, the element may be sufficiently flexible along its length so as to be coiled on a large diameter storage drum from which it may conventiently be unwound for feeding into the tubular structure. For this purpose the formation of an elongate element from a pair of face members which are maintained spaced apart by the aforementioned dividers, which preferably are relatively thin as compared with the face members, is particularly advantageous insofar as the resulting construction of the element is sufficiently rigid to be self-supporting when assembled to form the lining of a tubular structure, has a good strength to weight ratio, and is also capable of being wound on a large drum for storage prior to use.

If the materials or other features of the element result in it being insuficiently flexible for storage on a drum, the element(s) may be supplied in preselected discrete lengths.

One embodiment of the invention will now be described, by way of example, with reference to the accompanying diagrammtic drawings in which.

Figures 1, 2:
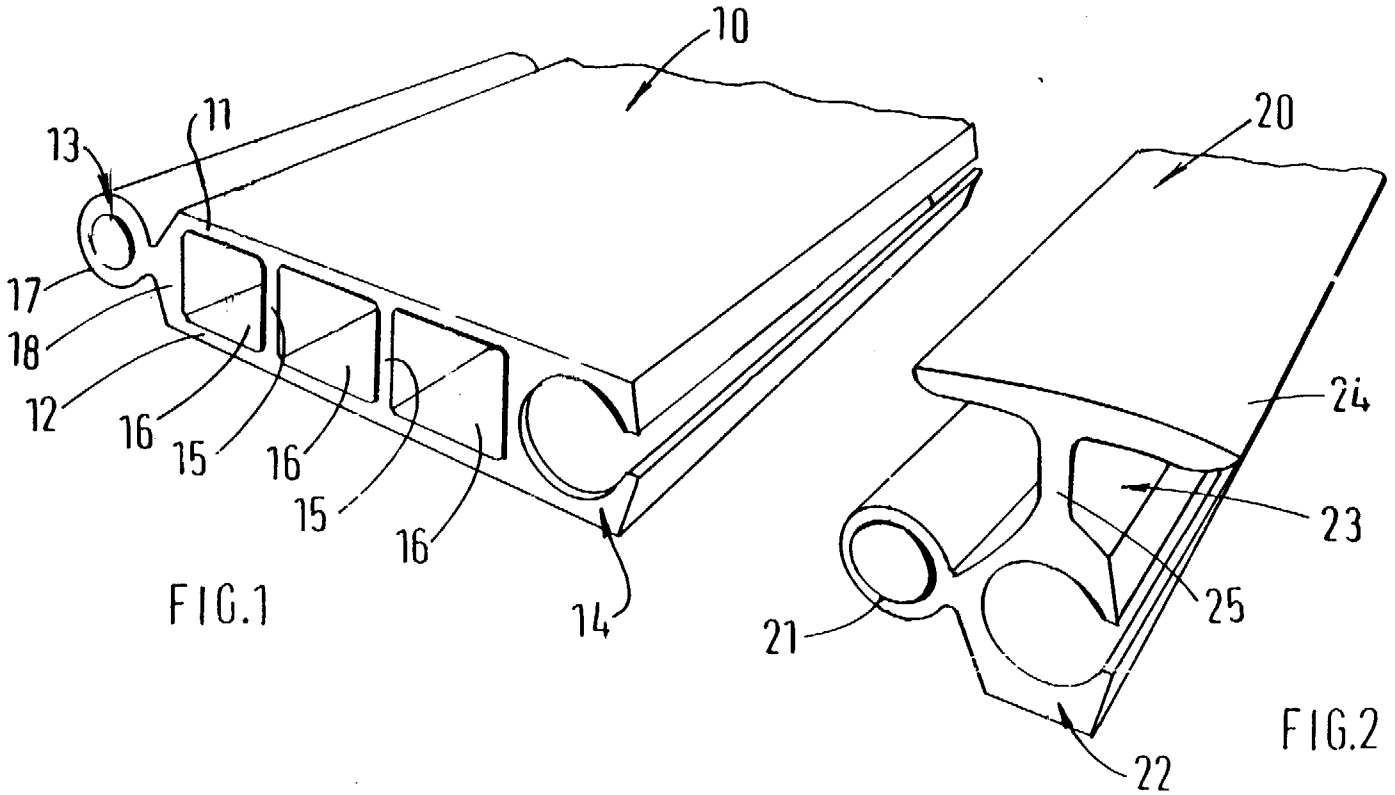
FIG. 1 shows in perspective an end portion of and elongate lining element.
FIG. 2 shows in perspective an end portion of an elongate spacer element.

An elongate lining element 10 (see FIG. 1) for lining a tunnel comprises a pair of face members 11,12 maintained spaced apart by a pair of edge formations 13,14 and a pair of wall dividers 15. The edge formations and wall dividers extend continuously along the length of the lining element and define therebetween, between the face members 11,12 three longitudinally continous cavities 16 each of substantially rectangular shape in cross-section.

One of the edge formations, 13, comprises a tubular formation 17 having a smooth external surface of a diameter slightly less than the spacing of the outer surfaces of the face members 11,12. The edge formation 13 additionally comprises an edge strip 18 which is integral with the tubular formation 17 and extends between the neighbouring longitudinal edges of the face members.

The other edge formation 14 is in the form of a longitudinally extending groove the internal surface of which has a shape complementary to that of the tubular formation 17 such that the formation 13 of another element may slide in and be guided by edge formation 14.

The lining element above described is manufactured from unplasticised polyvinyl chloride by extrusion, this material affording the edge formations 13,14 a low coefficient of friction. The described element has a width of 150 mm and thickness of 20 mm.

An elongate spacer element 20 for interconnecting a pair of lining elements and maintaining them slightly spaced from a tunnel wall is shown in FIG. 2.

The spacer element 20 comprises a side-by-side pair of longitudinally extending formations 21,22 corresponding respectively to the tubular 17 and edge formation 14 of the aforedescribed lining element 10. The spacer element additionally comprises a formation 23 which is T-shaped in cross-section and the head portion 24 of which is maintained spaced from but parallel with a plane containing the formations 21,22 by a tail portion 25.

The spacer element is also manufactured from p.v.c. by extrusion.

To line a tunnel long lengths of the elongate lining and spacer elements may be stored on a pair of drums, and said drums positioned at the head of a trench cut in the ground to have a gradual slope extending down to an access point in the tunnel.

A length of the lining element is then drawn into the tunnel from the drum, the length being cut either to that of the length of the tunnel under renovation or the maximum length for which elements can satisfactorily be slid into engagement, whichever is the greater. The spacer element is then drawn from its supply drum and fed into the tunnel with an edge formation of the spacer element co-operating with an edge formation of the lining element so as to effect guiding of the spacer element relative to the lining element and interlocking therewith.

Alternatively where the elements are provided in preselected discrete lengths they may be fed into the tunnel in a similar manner to result in the required interlocking.

Particularly where elements of long length are being interconnected, liquid lubricant may be supplied through the tubular formation 17 of the lining element (or corresponding formation of the spacer element) in such manner as to apply lubricant to the surface of the complementary groove formation just prior to sliding thereof over the outer surface of the tubular formation.

Successive lengths of the two types of elements are then supplied so as to result, for most installations, in an alternating series of spacer and lining elements. Where, however, there is no requirement for a significant thickness of grout between the tunnel and lining, such as for example at the floor regions, lining elements may be directly interconnected.

Figure 3:
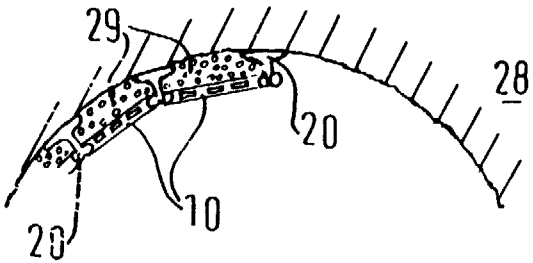
FIG. 3 is a cross-section of part of a tunnel structure lined with the elements of FIGS. 1 and 2.

FIG. 3 shows the upper part of a tunnel 28 lined with an alternating series of lining elements 10 and spacer elements 20 with the spaces between the lining elements 10 and tunnel wall and also the lining elements per se being filled with grout 29.

To facilitate lining of the roof portion of the tunnel use may be made of temporary supports for the elements, these supports being removed after the required number of linings have all been inserted.

Alternatively or additionally successive elements may be restrained from hinging one relative to the other by means of adhesive acting between the complementary formations of a pair of the elements. The adhesive may be applied instead of the lubricant, may act as the lubricant, or be an additive to the lubricant fed through the tubular formations in the above-described manner when necessary to facilitate relative sliding movement.

Figure 4:
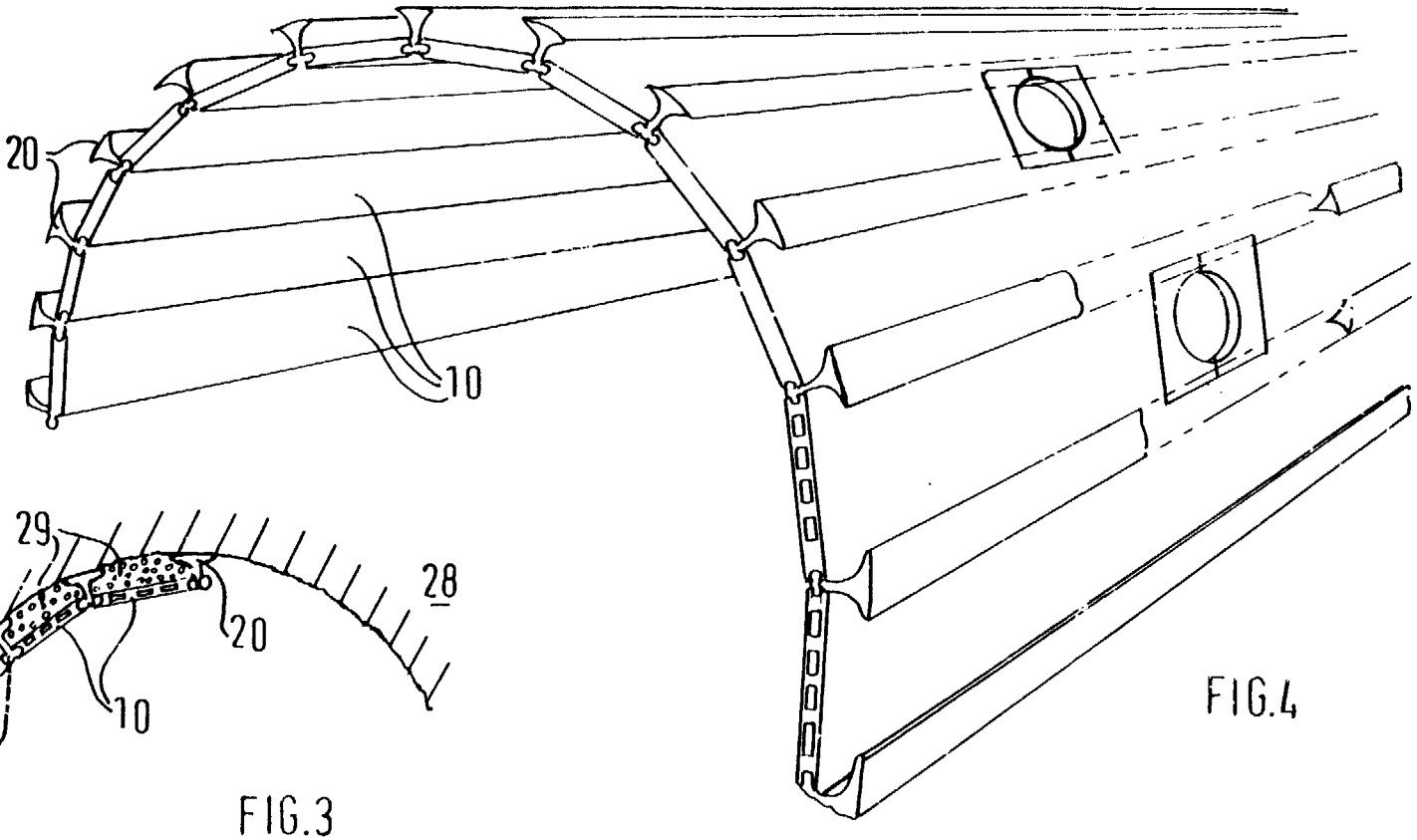
FIG. 4 is a perspective view of part of a tunnel lining assembly formed from the elements of FIGS. 1 and 2.
Figure 6:
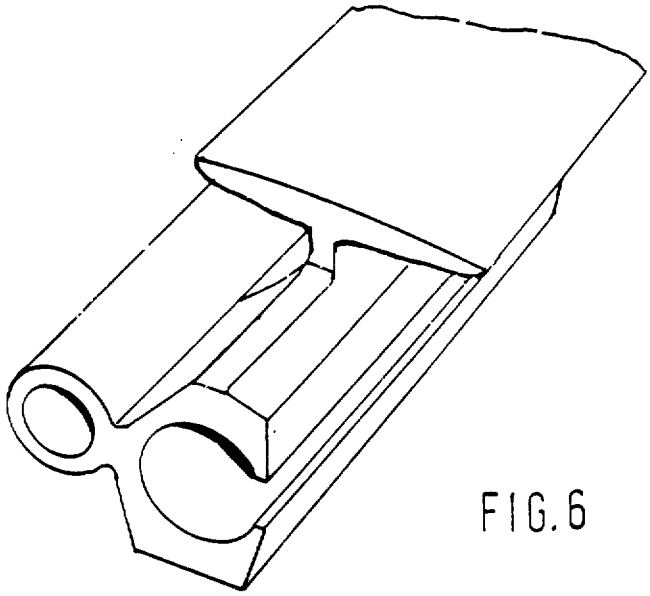
FIG. 6 is a perspective view of an end portion of a space element for use alongside the connector of FIG. 5.
Figure 5:
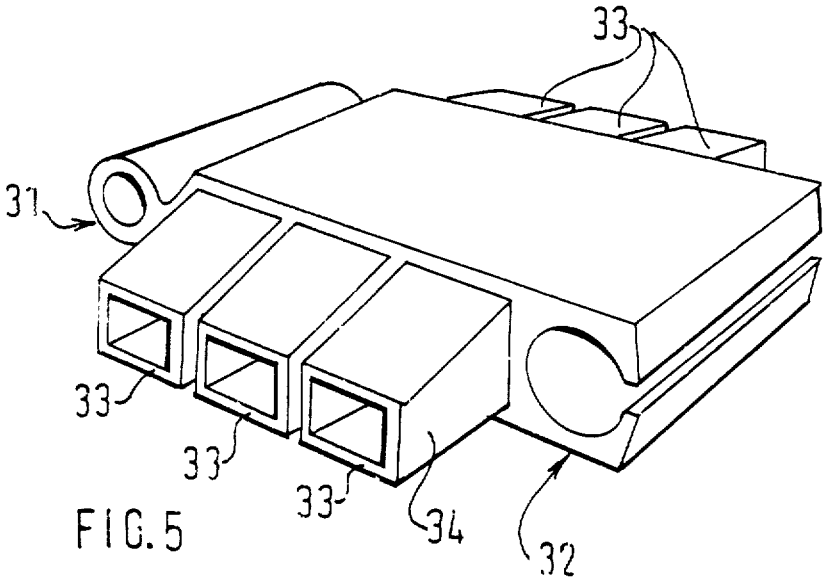
FIG. 5 is a perspective view of a connector for longitudinally connecting lining elements.

FIG. 4 shows an assembly of lining and spacer elements for lining the roof and slide parts of a tunnel.

Where it is requied to line a length of tunnel longer than the length of elements which can readily be slid one relative to the other, use may be made of end connectors 30 (see FIG. 6) for joining the ends of successive lining elements. Each connector has edge formations 31,32 corresponding to the formations 13,14 of a lining element, and tapered tubular location portions 33 for engagement in the cavities 16 of a lining element. The connector 30 is of a hollow construction, typically formed by joining two injection moulded sections (having a joint line shown as 34), and thus permits grout to be fed directly from the cavity 16 or tubular formation of one element into another element.

Where spacer elements 20 interconnect a pair of the connector elements it is preferably that the T-shaped formation 23 is cut-away (see FIG. 5) for a length corresponding to the longitudinal length of the connector. Thus when grout is fed to the space between the lining and tunnel wall there results a continuous reinforcing hoop of the grout around the joint region.

Figure 7:
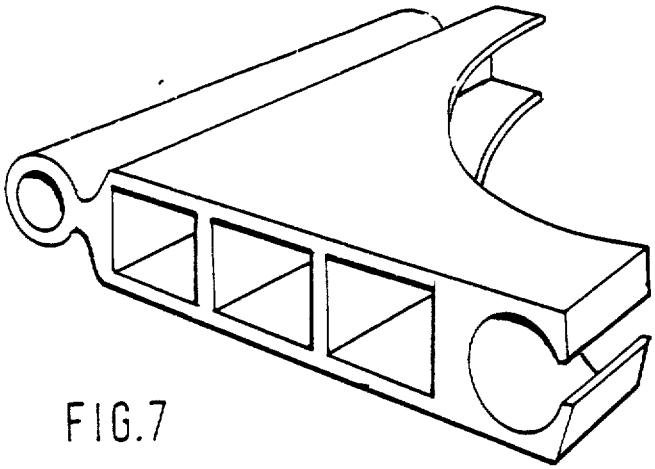
FIG. 7 shows in perspective part of a lining element for conforming to a side entry junction.

Having assembled required lining and spacer elements, one end of each cavity bore of each tubular formation is blanked off (except for a small air vent orifice) and grout is pressure injected into the bores and cavities. When this has set it results in a substantial increase in strength of the lining, and further grout material can then be injected between the lining and tunnel wall to fill the gap therebetween and crevices in the tunnel brickwork without any risk of collapse of the lining. If it is required to provide a lining at a tunnel junction preferably the elements are either pre-cut (see FIG. 7) or cut in situ in the tunnel before grout is injected either into the elements or between the elements and tunnel wall.

Having now described my invention what I claim is:

1. Method of lining a tunnel structure comprising:

feeding into the structure a plurality of longitudinally flexible elongate elements at least some of which are lining elements of a kind having at least one cavity which extends substantially continuously in the direction of the length of the element and at least some of which are spacer elements each comprising a longitudinally extending rib-like formation, said lining elements and spacer elements each having a pair of longitudinally extending edge formations each for interlocking assembly with a complementay shaped edge formation of an adjacent elongate element of the lining arranging said lining elements and said spacer elements to extend substantially parallel with the direction of the length of the structure with the elements disposed in a side-by-side and interlocking configuration in which the complementary shaped edge formations of adjacent elements are interlocked to form a lining which conforms substantially to the surface of the tunnel structure, the rib-like formations of the respective spacer elements being arranged to lie outwards of the lining wholly between the surface of the tunnel structure and that inward facing surface of the lining defined by the lining elements and to maintain the lining elements spaced from the internal surface of said tunnel structure;

and then injecting into said cavities a settable compound and allowing said settable compound to set.

2. Method according to claim 1 wherein settable compound is injected between the surface of the tunnel structure and the confronting surface of the lining formed by said elongate elements.

3. Method according to claim 2 wherein settable compound injected into the cavities of the elements is allowed to set before settable compound is injected between the tunnel structure and the lining formed by the elongate elements.

4. Method according to claim 1 wherein the elongate elements are brought into side-by-side relationship by feeding successive lengths into the tunnel structure in such manner that they slide along and are guided by an edge formation of an element already installed in the tunnel structure.

5. Method according to claim 4 including employing lubricant means to facilitate sliding movement of one element into position alongside another element.

6. Method according to claim 1 wherein relative movement of an assembled pair of interlocking elements is restrained by the use of an adhesive.

7. Method according to claim 6 wherein said adhesive is of a slow acting kind.

8. Method according to claim 6 wherein said adhesive acts as a lubricant means to facilitate sliding movement of one element into position alongside another element.

9. The method according to claim 4, wherein said longitudinally extending edge formations are employed for guiding one element into position alongside another element.

10. The method according to claim 5, wherein at least one element has a hollow edge formation and wherein lubricant is supplied through said hollow edge formation for lubrication of the sliding movement.

11. A tunnel lining comprising:

a plurality of elongate elements arranged to extend parallel one to another in the directin of the length of the tunnel lining; at least some of said elements being lining elements of a kind having a cavity which extends longitudinally and substantially continuously in the direction of the length of the element and into which a settable compound has been injected an allowed to set, at least some of the other of said elements being spacer elements of a kind each comprising a longitudinally extending rib-like formation; said lining elements and said spacer elements each having a pair of substantiallly longitudinally extending edge formations and adjacent elements of the lining being maintained inside a tunnel structure in an interlocked assembly by said complementary shaped edge formations; and the rib-like formations of said spacer elements lying wholly between the surface of the tunnel structure and the inwardly facing surface of the lining defined by said lining elements such that said rib-like formations maintain the lining elements spaced from the internal surface of a tunnel structure.

12. A tunnel lining according to claim 11, wherein said rib-like formation comprises in cross-section a head portion which bears against the internal surface of the tunnel structure and a tail portion which extends generally outwardly from the lining between the lining and said head portion.

13. A tunnel lining according to claim 11 wherein elongate elements are maintained in interlocked relationship by edge formations at least one of which has a surface formed of low friction material.

14. A tunnel lining according to claim 11 wherein a lining element comprises a pair of face members maintained spaced apart by a divider which extends along the length of the element thereby to define in part at least two cavities in said element.

* * * * *